United States Patent [19]

Seaborne

[11] Patent Number: 4,818,831

[45] Date of Patent: Apr. 4, 1989

[54] AMPHOTERIC CERAMIC MICROWAVE HEATING SUSCEPTOR

[75] Inventor: Jonathan Seaborne, Corcoran, Minn.

[73] Assignee: General Mills, Inc., Minneapolis, Minn.

[21] Appl. No.: 66,376

[22] Filed: Jun. 25, 1987

[51] Int. Cl.[4] ..... H05B 6/80

[52] U.S. Cl. ..... 219/10.55 E; 219/10.55 F; 426/113; 426/243; 99/DIG. 14; 206/591

[58] Field of Search ..... 219/10.55 E, 10.55 F, 219/10.55 M, 10.55 R; 426/107, 110, 113, 241, 243; 99/451, DIG. 14; 206/591, 593, 594; 501/94

[56] References Cited

U.S. PATENT DOCUMENTS

| | | | |
|---|---|---|---|
| 2,582,174 | 1/1952 | Spencer . | |
| 2,830,162 | 4/1958 | Copson et al. | 219/10.55 F |
| 3,585,258 | 6/1971 | Levinson . | |
| 3,591,751 | 7/1971 | Goltsos | 219/10.55 |
| 3,705,054 | 12/1972 | Matsushita et al. . | |
| 3,783,220 | 1/1974 | Tanizaki | 219/10.55 F |
| 3,853,612 | 10/1974 | Spanoudis | 117/212 |
| 3,857,009 | 12/1974 | MacMaster et al. | 219/10.55 F |
| 3,922,452 | 11/1975 | Forker, Jr. et al. | 219/10.55 |
| 3,946,187 | 3/1976 | MacMaster et al. | 219/10.55 E |
| 3,946,188 | 3/1976 | Derby | 219/10.55 E |
| 4,003,840 | 1/1977 | Ishino et al. | 219/10.55 D |
| 4,190,757 | 2/1980 | Turpin et al. | 219/10.55 E |
| 4,219,361 | 8/1980 | Sutton et al. | 106/63 |
| 4,230,924 | 10/1980 | Brastad et al. | 219/10.55 E |
| 4,266,108 | 5/1981 | Anderson et al. | 219/10.55 E |
| 4,267,420 | 5/1981 | Brastad | 219/10.55 E |
| 4,283,427 | 8/1981 | Winters et al. | 426/107 |
| 4,341,872 | 7/1982 | MacDowell | 501/6 |
| 4,590,349 | 5/1986 | Brown et al. | 219/10.55 E |
| 4,592,914 | 6/1986 | Kuchenbecker | 426/107 |
| 4,594,492 | 6/1986 | Maroszek | 219/10.55 E |
| 4,661,299 | 4/1987 | Thorsrud | 264/25 |

OTHER PUBLICATIONS

"Controlled Microwave Heating and Melting of Gels", by Roy et al., J. Am. Ceram. Soc 68(7), 392–95, (1985).

"Microwave Heating of Neptheline Glass Ceramics", by J. MacDowell, Ceramic Bulletin, vol. 63, No. 2, (1984).

*Primary Examiner*—A. D. Pellinen
*Assistant Examiner*—Leon K. Fuller
*Attorney, Agent, or Firm*—John A. O'Toole

[57] ABSTRACT

Disclosed are improved ceramic compositions which are useful in the formulation of microwave susceptors and to the susceptor articles fabricated therefrom for disposable packages for the microwave heating of food items. The compositions include a novel microwave absorbing material and a binder. The novel microwave absorbing materials comprise selected ceramics in both their native and amphoteric forms. Such ceramics are those with residual lattice charges or an unbalance of charge in the fundamental framework or layers such as vermiculite, bentonite, hectorite, selected micas including Glauconite, Phlogopite and Biotite and mixtures thereof. These ceramics are activated to their amphoteric form by treatment with either acids or bases. The compositions provide good heat generation and a predeterminable upper temperature limit which is higher in the amphoteric form than in their native form. The ceramic materials are common and inexpensive. Preferred compositions additionally include a temperature profile moderator which can be common salt.

20 Claims, 6 Drawing Sheets

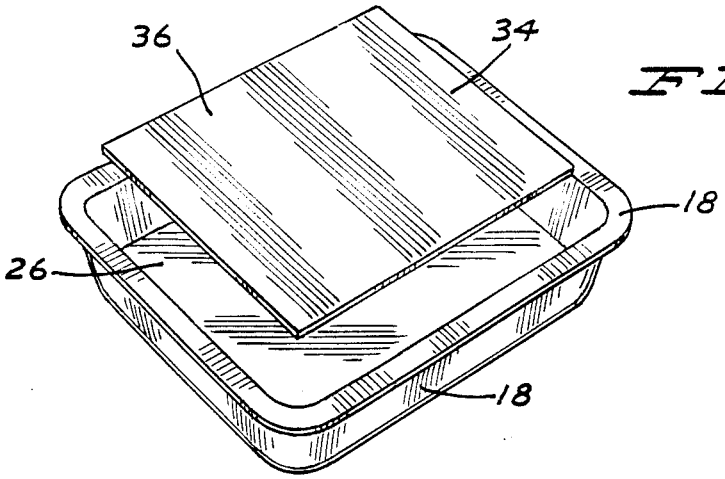
FIG. 4
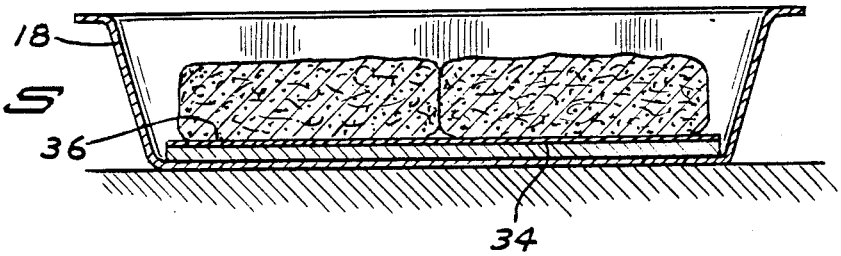
FIG. 5
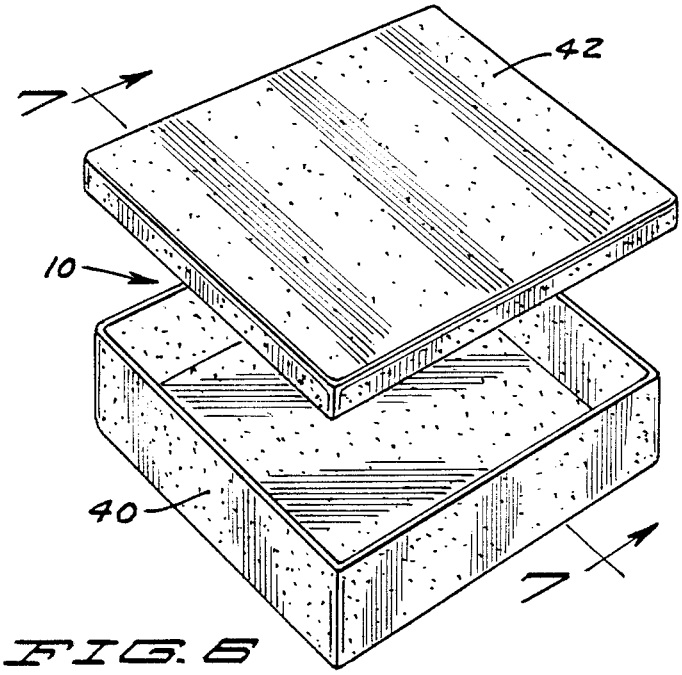
FIG. 6
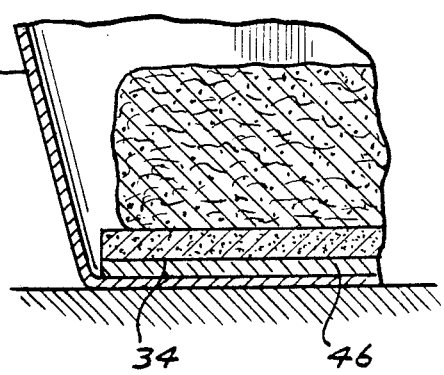
FIG. 5A
FIG. 7
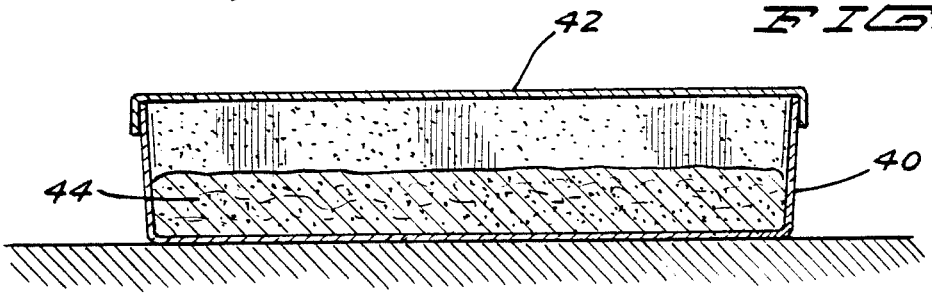

AMPHOTERIC CERAMIC MICROWAVE HEATING SUSCEPTOR

BACKGROUND OF THE INVENTION

1. The Technical Field

This invention relates generally to the art of the microwave heating by high frequency electromagnetic radiation or microwave energy. More particularly, the present invention relates to ceramic compositions useful for fabrication into microwave susceptors, and to microwave heating susceptors fabricated therefrom, suitable for disposable microwave packages for food products.

2. Background Art

The heating of food articles with microwave energy by consumers has now become commonplace. Such microwave heating provides the advantages of speed and convenience. However, heating certain food items, e.g., breaded fish postions with microwaves often gives them a soggy texture and fails to impart the desirable browning flavor and/or crispness of conventionally oven heated products due in part to retention of oil and moisture. Unfortunately, if microwave heating is continued in an attempt to obtain a crisp exterior, the interior is generally overheated or overdone. Moreover, the microwave fields in the ovens are uneven which can lead to unevenness or both hot and cold spots within food items or packaged food items being heated.

The prior art includes many attempts to overcome such disadvantages while attempting to retain the advantages of microwave heating. That is, the prior art includes attempts at providing browning or searing means in addition to microwave heating. Basically, three approaches exist whether employing permanent dishes or disposable packages to provide microwave heating elements which provide such browning or searing and which elements are referred to herein and sometimes in the art as microwave heating susceptors. In the art, materials which are microwave absorptive are referred to as "lossy" while materials which are not are referred to as "non-lossy" or, equivalently, merely "transparent."

The first approach is to include an electrically resistive film usually quite thin, e.g., 0.00001 to 0.00002 cm., applied to the surface of a non-conductor or non-lossy substrate. In the case of a permanent dish, the container is frequently ceramic while for a disposable package the substrate can be a polyester film. Heat is produced because of the $I^2R$ or resistive loss (see, for example, U.S. Pat. Nos. 3,853,612, 3,705,054, 3,922,452 and 3,783,220). Examples of disposable packaging materials include metallized films such as described in U.S. Pat. Nos. 4,594,492, 4,592,914, 4,590,349, 4,267,420 and 4,230,924.

A second category of microwave absorbing materials comprise electric conductors such as parallel rods, cups or strips which function to produce an intense fringing electric field pattern that causes surface heating in an adjacent food. Examples include U.S. Pat. Nos. 2,540,036, 3,271,552, 3,591,751, 3,857,009, 3,946,187 and 3,946,188. Such an approach is only taken with reusable utensils or dishes.

A third approach is to form articles from a mass or bed of particles that become hot in bulk when exposed to microwave energy. The microwave absorbing substance can be composed of ferrites, carbon particles, etc. Examples of such compositions or articles prepared therefrom include, U.S. Pat. Nos. 2,582,174, 2,830,162 and 4,190,757. These materials can readily experience runaway heating and immediately go to temperatures in excess of 1200° F. even with a food load to absorb the heat so generated. Some control over final heating temperature is obtained by lowering of Curie point by addition of dopants or selected binders.

A review of the prior art, especially that art directed towards provision of heating susceptors for disposable packages for microwave heating of foods indicates that at least three basic problems exist in the formulation and fabrication of heating susceptors. One difficulty with the third category of materials, generally, is that they can exhibit runaway heating, that is, upon further microwave heating their temperature continues to increase. Great care must be taken in fabrication of safe articles containing such materials. Metallized film materials of the first category can be formulated and fabricated such that they do not exhibit runaway heating. However, such films suffer from the second problem; namely that while their operating temperatures are quite hot, are at controlled temperatures, and are sufficient to brown the surface of nearby food items, due to their thinness and low mass, only small quantities of heat are actually generated. Such materials are thus unsuitable for certain foods which require absorption of great amounts of heat or "deep heating" in their preparation, e.g., cake batters. The third general problem is one of cost. Microwave susceptors frequently comprise costly materials. Also, fabrication of susceptor structures frequently is complex and expensive.

Accordingly, in view of the above-noted problems with present microwave susceptors, an object of the present invention is to provide materials and devices fabricated therefrom which will heat under the influence of the microwave radiation up to an upper temperature limit at which temperatures the device comes to a steady state absorption of microwave energy and heating to a higher temperature is precluded.

Another object of the present invention is to provide microwave heating materials for and device or microwave susceptors fabricated therefrom which are disposable and adapted for use with pre-prepared foods.

A still further object of the present invention is to provide microwave heating materials for and device or microwave susceptors fabricated therefrom which can be utilized as a non-disposable utensil or tray.

A still further object of the present invention is to provide microwave heating materials for and devices fabricated therefrom which by appropriate selection of manufacturing parameters can provide a predetermined upper temperature limit and moderate microwave heating of the food item through absorption and moderation of the microwave energy.

Another object of the present invention is to provide heating materials for and devices fabricated therefrom which are inexpensive to manufacture, safe to use and well adapted for their intended use.

Surprisingly, the above objectives can be realized and new compositions provided which overcome the problems associated with previous materials which have been used for the fabrication of microwave heating susceptors. The present compositions and devices do not exhibit runaway heating yet generate relatively large amounts of heat. Indeed, the final heating temperature can be controlled quite closely. Also, the present compositions are comprised of materials which are commonly available and cheap. In the most surprising aspect of the present invention, the compositions comprise ceramic materials previously considered to be microwave transparent or used in microwave transparent ceramic compositions.

BRIEF DESCRIPTION OF THE DRAWINGS

FIG. 4 is a perspective view of the tray with the food items removed showing a microwave heating susceptor raised above its resting position in the tray;

FIG. 5 is a cross sectional view of the tray taken in the direction of lines 5—5 of FIG. 3;

FIG. 6 is a perspective view of an alternate tray with a lid each fabricated from the present compositions with food items removed;

FIG. 7 is a perspective view of the alternate tray taken in the direction of lines 7—7 of FIG. 6.

SUMMARY OF THE INVENTION

Figure 1:
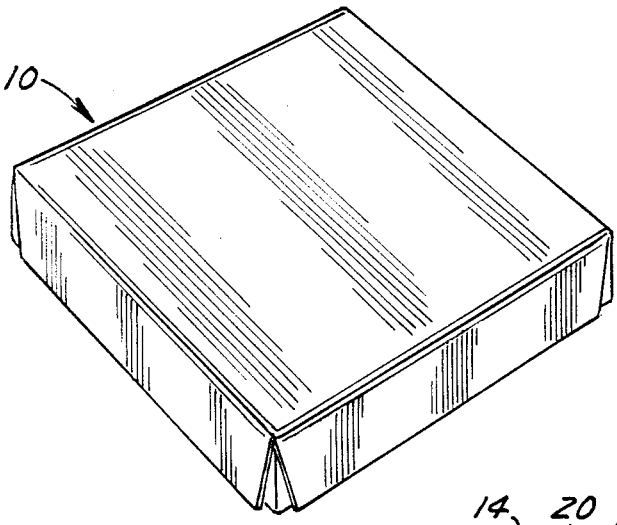
FIG. 1 is a perspective view of a packaged food article for microwave heating constructed in accordance with the teachings of the invention.

The present invention provides compositions useful in the formulation and fabrication of microwave heating susceptors. The present compositions comprise an active microwave absorbing material and a binder.

The present microwave absorbing materials are common ceramic ingredients having a cation exchange capability (C.E.C.). In preferred embodiments, the material is activated to its amphoteric form by treatment with either acids or bases.

In its article aspect, the present invention resides in microwave susceptor devices fabricated from the present compositions. Such devices are microwave heating susceptors generally in sheet form and which range in thickness from about 0.05 to 8.0 mm. In preferred embodiments, the heating susceptor is in the form of a tray. The susceptors find particular usefulness in disposable packages for the microwave heating of foods. Also, the present articles embrace microwave packaging for foods and food articles for microwave heating.

DETAILED DESCRIPTION OF THE INVENTION

The present invention relates to compositions useful for fabrication into heating susceptors for disposable packages for the microwave heating of food products. The compositions comprise defined microwave absorbing material and a binder. In its article aspect, the present invention provides new and improved microwave heat susceptors to packages for such items, to microwave packages for food items and to the packaged food item themselves. Each of the composition ingredients and susceptor elements and articles are described in detail below.

Throughout the specification and claims, percentages are by weight and temperatures in degrees Fahrenheit, unless otherwise indicated.

The microwave absorbing materials useful herein surprisingly include a wide variety of ceramic materials previously regarded as microwave transparent or used in ceramic compositions transparent to microwaves. By ceramic materials are meant substantially non-ferrous materials comprising oxygen attached to non-carbonaceous elements, and primarily to magnesium, calcium, iron, aluminum, silicon and mixtures thereof although the materials may include incidental iron and other related elements.

In the ceramic industry, a distinction is made between "greenware," a ceramic composition before firing, and finished, fired ceramic compositions. The firing step profoundly changes a large number of properties of the ceramic composition as the individual constituents are fused into a homogeneous mass. Broadly speaking, the present invention is directed toward compositions which would be considered greenware in the ceramic arts.

Certain of the microwave active materials have been used in greenware ceramic compositions, but generally at marketedly different concentrations and for different purposes than in the present invention. For example, ceramic compositions containing minor amounts, e.g., 1–2%, of vermiculite are known. However, since vermiculite can expand or even explode during firing, ceramic compositions with high vermiculite levels of the present invention are not known. Mica, for example, is not used at high concentrations in fired ceramics since it adversely affects strength.

The present materials are further essentially characterized by a residual lattice charge or synonomously for purposes herein as having a positive cation exchange capability. The materials are further characterized by relatively low electrical resistivity, i.e., about 0.1 to 35 ohm.cm and are thus classifiable as semiconductors.

The present materials and their properties are well known and described generally, for example, in "An Introduction to the Rock Forming Materials," by Deer, Howie and Zussman, Longman Group Limited, Essex, England, 1966. Materials are as therein described generally classified as ortho and ring silicates, chain silicates, sheet silicates, framework silicates and non-silicates. The materials useful herein can fall into any of these classifications although not all materials in those classifications are useful herein.

As indicated above, the microwave absorbing materials useful herein surprisingly include a wide variety of ceramic materials previously regarded as microwave transparent. It is speculated herein that these materials have heretofore been unappreciated as being useful as consumer microwave absorbing materials since most investigations of their electromagnetic interactions, i.e., absorption/transparency has been done at very different frequencies or have been investigated as fired ceramics.

Exemplary specific materials include Vermiculite, $(Mg,Ca)_{0.7}\ (Mg,Fe^{+3},Al)_{6.0}\ [(Al,Si)_8O_{20}]\ (OH_4).8H_2O$ including both native and exfoliated (i.e., having been subjected to roasting heat of 1200° F. whereby the vermiculite is expanded by the loss of bound water);

Glauconite;

$$(K,Na,Ca)_{1.2-2.0}(Fe^{+3},Al,Fe^{+2},Mg)_{4.0}[Si_{7-7.6}Al_{1-0.4}O_{20}](OH)_4.n(H_2O);$$

Bentonites;

$$(\tfrac{1}{2}Ca,Na)_{0.7}(Al,Mg,Fe)_4[(Si,Al)_8O_{20}](OH_4).n(H_2O);$$

Phlogopites;

$K_2(Mg,Fe^{+2})_6[Si_6Al_2O_{20}](OH,F)_4$.

Other materials with residual lattice charges can be used, e.g., chlorites, illite, hectorites, saponites, attapulgites, sepiolites, smectites, and the like and mixtures thereof. Preferred materials include vermiculite, bentonite, hectorite, saponite, micas, zeolites and illite and mixtures thereof due to the relatively flat and/or uniformity of their final heating temperature profiles, i.e., measured temperature plotted over time when exposed to constant microwave rates.

Surprisingly, these materials will experience heating activity when exposed to consumer microwave energy frequency (2450 MHz) in their native form. However, it has been even more surprisingly discovered that this native microwave absorption activity can be greatly increased or modified by treatment of these materials to either acid or base treatment. The resulting acid or base activated or "charged" materials are collectively referred to as "amphoteric materials," i.e., materials which are reactive to both acids and bases, or, equivalently, materials in their "amphoteric" form as opposed to their native form.

The present amphoteric materials can be obtained by treating the materials in an excess of aqueous solutions, e.g., of acids ranging from mild to strong pH of 6.9 to 0.5. Useful acids include all manner of mineral or organic acid including Lewis acids and bases. Useful acids, for example, include hydrochloric, nitric, phosphoric, sulfuric acid, citric, acetic, boric acid and aluminum chloride. Also useful herein to achieve a basic amphoteric form is to treat the materials with mild solutions, e.g., pH of 7.0 to 11, of bases, e.g., sodium hydroxide, sodium carbonate, bicarbonate, acetate, potassium bicarbonate, hydroxide, acetate, urea, triethanolamine and ammonium hydroxide. Due to the density and surface area of these materials, treatment can be readily accomplished by simple steeping in sufficient amounts of solution to cover the materials. The duration of the step is not critical and good results can be obtained from as little as one minute of treatment although longer treatment is preferred.

While not wishing to be bound by the proposed theory, it is speculated herein that the pH treatment causes ion implantation to the backbone or lattice framework of the mineral thereby changing or modifying the lattice charges and the ionic character or ratio of the treated materials.

The present compositions include an effective amount of the above-described microwave absorbing materials. The precise level will depend on a variety of factors including end use application-active material(s) selected, amount and type of acid or base to charge the materials, desired final temperature, and thickness of the susceptor device. Good results are generally obtained when the microwave absorbing material comprises from about 5% to about 100% by weight of the present ceramic compositions. Preferred compounds include from about 15 to 95% by weight of the microwave absorbing material. For best results, the ceramic compositions comprise about 30% to 95% by weight of the microwave absorbing materials. The particle size of the microwave absorption material or refactory is not critical. However, finely ground materials (through 70 mesh screens U.S. Standard or 200 micron diameter) are preferred inasmuch as the ceramic susceptors produced therefrom are smooth and uniform in texture.

Another essential component of the present ceramic compositions is a conventional ceramic binder. By the term "ceramic binder" is meant that the binder is capable of binding the present ceramic heating materials into a solid mass. The term is not meant to imply or require that the binder material itself is necessarily ceramic in composition although it well may be. Such ceramic binders are well known in the ceramic art and the skilled artisan will have no problem selecting suitable binder materials for use herein. The function of the binder is to form the particulate microwave absorbing material into a solid form or mass. Exemplary materials include both ceramic and plastic binder materials, including, for example, cement, plaster of Paris, i.e., calcium sulphate, silica fiber, feldspar, pulverized Kevlar® (a polyamide fiber), colloidal silicas, fumed silicas, fiberglass, silica flour, selected micas, selected talcs, silicone, epoxy, crystallized polyester, wood pulp, cotton fibers, polyester fibers, lignin sulphonate, Kevlar®, calcium carbonate, dolomite, pyrophyllite, nepheline, flint flour, mullite, selected clays and mixtures thereof. The binder can comprise from about 0.10% to 99.9% by weight of the present ceramic compounds, preferably from about 1.0% to 80%. Additional exemplary, conventional plastic based binders, both thermoplastic and thermosetting, are described in U.S. Pat. No. 4,003,840 (issued Jan. 19, 1977 to Ishino et al.) which is incorporated herein by reference.

In one preferred embodiment, the present compositions include binders which are organic thermoplastic resins especially those approved as food packaging material such as polyvinyl chloride, polyethylene, polyamides, polyesters, polycarbonates, polyamides, epoxies, etc. In these embodiments, the thermoplastic resin binders can range from as little as 20% up to 60% of the composition and preferably about 30% to 50%. Such compositions are especially well suited for fabrication into shaped microwave susceptors, especially food trays, e.g., for TV dinners or entrees.

Upon heating in a conventional microwave oven, e.g., 2450 MHz, the ceramic compositions will relatively quickly (e.g., within 30 to 300 seconds) heat to a final temperature ranging from about 300° F. to 800° F. which temperature range is very desirable in providing crisping, browning to foods adjacent thereto and consistent with safe operation of the microwave oven. Both the final operating temperature as well as the rapidity to which it is reached is dependent upon whether the material is in its amphoteric state and the degree thereof. Another advantage is that the heating temperature profile with respect to time is relatively flat. It is speculated herein that these materials have heretofore been unappreciated as being useful as consumer microwave absorbing materials since most investigations of their electromagnetic absorption/transparency has been done at very different frequencies.

In one highly preferred embodiment, the present ceramic compositions additionally desirably comprise a temperature profile modulator. The temperature profile modulator can assist the compositions in reaching more quickly the final operating temperature reached by the ceramic composition. Also, the salt increases modestly the final operating temperature of the ceramic composition. The effect of the heating profile moderator when added to the unactivated or natural form of the present active ingredient is, generally speaking, merely additive. Surprisingly, however, the effect upon the amphoteric form of the salt with respect to heating temperature is highly synergistic.

The preferred ceramic compositions comprise from about 0.001% to about 10% by weight salt. Preferably, the present compounds comprise from about 0.1% to 6% of the moderator. For best results about 1% moderator is used. While ceramic compositions can be formulated having higher amounts of salt, no advantage is derived therefrom. It is also believed important that the temperature profile moderator exist in an ionized form in order to be functional. Thus, ceramic compositions beneficially containing salt should contain some moisture at some point in the composition preparation.

The present ceramic compositions can be fabricated into useful articles by common ceramic fabrication techniques by a simple admixture of the materials into a homogeneous blend, and for those binders requiring water, e.g., cement or calcium sulphate addition of sufficient amounts of water to hydrate the binder. Typically, water will be added in a weight ratio to composition ranging from about 0.07 to 1:1. While the wet mixture is still soft, the ceramic compositions can be fabricated into desirable shapes, sizes and thicknesses and thereafter allowed to harden. The materials may be dried at accelerated rates without regard to drying temperatures and can be dried with air temperatures even in excess of 180° F. but less than fusion or firing temperatures (<1000° F.). Another common fabrication technique is referred to as compression molding In compression molding a damp mix, e.g., 3% to 10% moisture for water activated binders, are employed, or a dry mix if not, is placed into a mold and subjected to compression to effect a densification of the composition to form a firm body. Still another useful fabrication technique is isostatic pressing which is similar to compression molding but with one side of the mold being flexible. Isostatic pressing is especially useful in forming curved ceramic pieces.

The final heating temperature of the present compositions is mildly influenced by the thickness of the susceptor elements fabricated. Good results are obtained when susceptor thickness ranges from about 0.4 to 8 mm in thickness. Preferred susceptors have thicknesses ranging from 0.7 to 4 mm. All manner of shapes and size heating susceptors can be fabricated although thin flat tiles are preferred in some applications.

Still another advantage of the present invention is that susceptors fabricated from the present ceramic compositions provide a microwave field modulating effect, i.e., evening out peaks and nodes, i.e., standing wave points and, it is believed independent of wattage. This benefit is especially useful when sensitive foods such as cookie doughs or protein systems are being microwave heated.

Still another advantage of the present ceramic compositions is that they are believed to be useful not only with microwave ovens operating at 2450 MHz but at all microwave frequencies, i.e., above as low as 300 MHz.

Still another advantage of the present ceramic susceptor compositions is that they can be fabricated into heating elements which can absorb oil. Such a feature is particularly useful when used to package and to microwave heat food items which are pafried. A further unexpected advantage is that such oil absorption has minimal adverse effects on heating performance in terms of final heating temperatures reached or upon heat generation.

Another advantage is that the ceramic susceptor can be coated with plastics or inorganic coatings to render the surface non-absorptive to moisture and oil as well as providing a non-stick surface. Also; colorants, both organic and inorganic in nature may be incorporated at appropriate levels into either the coating or body of the ceramic susceptor to aid in aesthetics without adversely affecting the performance of the ceramic susceptor.

It is important that the susceptors fabricated herein be unvitrified, i.e., not subjected to a conventional firing operation generally above 800° F. to 1000° F. (426° C. to 538° C.). Conventional firing can result in a fused ceramic composition substantially transparent to microwave and thus devoid of the desirable microwave reactive properties of the present invention.

The present ceramic compositions are useful in any number of microwave absorption applications. The present ceramic compositions are particularly useful for fabrication into microwave susceptors which in turn are useful as components in packages for foods to be heated with microwaves.

Figure 2:
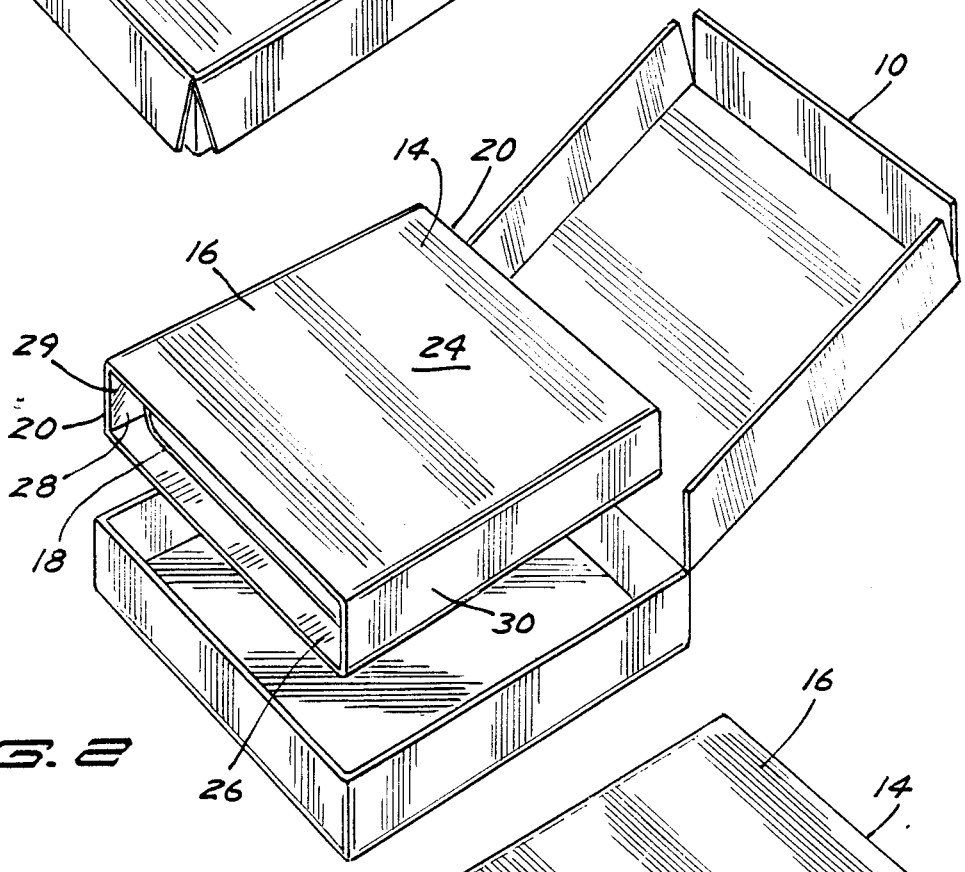
FIG. 2 is a perspective view of the packaged food article with outer paperboard outerwrap opened and with an inner tray and sleeve shown disengaged.

For example, FIG. 1 illustrates generally a packaged food item 10 fabricated in accordance with the teachings of the present invention and suitable for microwave heating. FIG. 2 shows that the article 10 can optionally comprise a six-sided outerwrap 12 which can be plastic, e.g., shrink wrap, paper or other conventional packaging material such as the paperboard package depicted. The article can further comprise an inner assembly 14 disposed within the outerwrap 12 which can comprse a sleeve 16 fabricated from a dielectric material and disposed therein a tray 18. In conventional use, the consumer will open the article 12, remove and discard the overwrap 12, and insert the entire assembly into the microwave oven. The sleeve 16 is helpful although not essential not only to prevent splattering in the microwave oven, but also to assist in securing the food items against excessive movement during distribution.

Figure 3:
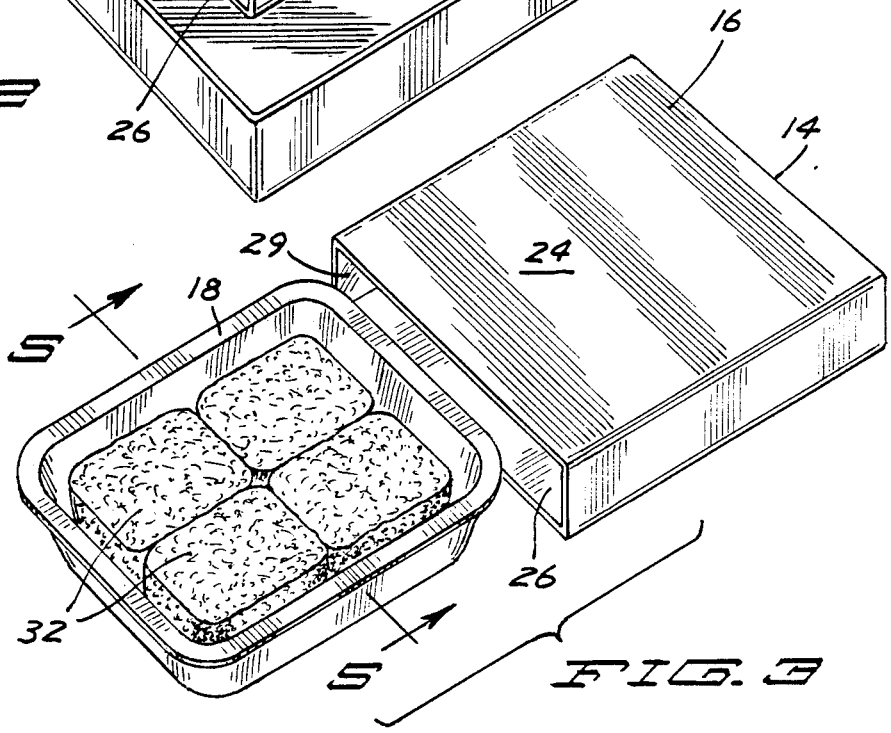
FIG. 3 is a perspective view of the tray disengaged from the sleeve and holding several food pieces.

In FIG. 2, it can be seen that the sleeve 16 can comprise an opposed pair of open ends, 20 and 22, an upper major surface or top wall 24, a lower major surface or bottom wall 26 and an opposed pair of minor side or wall surfaces 28 and 30. As can be seen in FIG. 3, the tray 18 holds or contains one or more food items 32. FIG. 4 shows the tray 18 with the food items 32 removed. Disposed within the tray 18 is one or more microwave heating susceptors such as microwave susceptor heating panel 34. In this preferred embodiment, the susceptors are generally flat or planar and range in thickness from 0.020 to 0.250 inch.

Still referring to FIG. 3 and 4, with the cooking of certain foods, it may be desirable to heat the food items 32 from only or primarily one side by use of the heating susceptor panel 34 while at the same time minimizing the heating of food item 32 by exposing it to microwave radiation through the walls of the package assembly 14. To allow microwave radiation to reach the susceptor 34, the bottom wall 26 is microwave transparent at least to the extent that sufficient microwave energy can enter the package to heat the susceptor 34. Side walls 28 and 30 can each optionally be shielded with shielding 29 as can top wall 24 thereby restricting the entry of microwave radiation through these walls to the food product as is known in the art. The shielding 29 can be of any suitable type material of which aluminum foil is a currently preferred material. With the use of shielding, the microwave radiation penetrates the microwave transparent bottom 26 only. Accordingly, cooking of the food product 32 in this embodiment is accomplished substantially totally by the heat transferred to the food product 32 from the susceptor 34 although some microwave entry through the open ends 20 and 22 occurs. It is pointed out that the terms microwave transparent and microwave shield are relative terms as used herein and in the appended claims.

In FIG. 5, it can be seen that the heating panel 34 can optionally comprise a thin finish layer 36, e.g., 0.00005 to 0.001 inch (0.001 to 0.025 mm) to impart desirable surface properties, e.g., color, water repellency, smooth appearance, stick free, etc. In the simplest form, such a layer can comprise ordinary paraffin or a sodium silicate polymerized with zinc oxide. The finish layer does not substantially adversely affect the performance of the microwave susceptor. Such surface property modification finds particular usefulness when the microwave susceptors are used in medical settings. For example, it is known to fabricate surgical implants, e.g., discs, cylinders, from ferrites which absorb microwave radiation to thermally treat tumors. In such applications wherein the present compositions are employed, water repellency may be particularly desirable.

Other types of packages can be utilized with the ceramic microwave heater compositions of the present invention. It is an important advantage that the present compositions can be fabricated into susceptors of different configurations whether regular, e.g., corrugated, or irregular.

Another embodiment is depicted in FIG. 6. Thermoplastic resins are preferred for use as the binder materials. In this embodiment, the article 10 in addition to outerwrap 12 as shown in FIG. 2 can comprise a microwave heating susceptor 40 fabricated into trays or shallow pans whether square, rectangular, circular, oval, etc. which serve both to contain and heat the food items. Such tray shaped susceptors 40 find particular suitability for use in connection with a batter type food item 44, especially cake batters or with casseroles, baked beans, scalloped potatoes, etc. In one particular embodiment the tray 40 can additionally include a cover 42 also fabricated from the present ceramic compositions. Trays 40 with covers 42 are especially useful for batter food items like brownies in which it is desired to form an upper or top skin to the food item 44.

In still another embodiment shown in FIG. 5A, the panel susceptor 34 can additionally comprise a backing layer(s), especially a metal foil, e.g., aluminum 46. The foil serves to reflect back to the susceptor 34 microwave energy passing through the susceptor 34. The incorporation of a microwave shielding or reflecting layer 29 in close proximity on the opposite surface of the ceramic susceptor 34 also serves to act as a susceptor temperature booster to elevate the operating temperature substantially above the temperature obtained without a microwave shielding or reflective layer 29. Final temperature reached can be as high as 100° F. or more over similar structures without the metal foil. Also, the use of the temperature booster can reduce the need for a thicker ceramic susceptor to obtain the same temperature thereby reducing both production costs as well as final weights of the microwave package. Since the ceramic compositions adhere to the metal foil with some difficulty, and cause an in heating interference due to conductor-wave phenomena interaction, it is preferable to treat the surface of the metal foil with an intermediate or primer layer (not shown) for better adherency, i.e., ordinary primer paints, or to have an intermediate silicone layer, or to select those binders for the ceramic compositions with increased capacity to adhere to metal foils.

The skilled artisan will also appreciate that the present compositions absorb microwave radiation at a wide range of frequencies and not merely at those licensed frequencies for consumer microwave ovens.

Other types of packages can be utilized with the heater of the present invention. The susceptor compounds of the present invention can also be utilized in non-disposable utensils adapted for repetitive heating cycles by embedding the heater or otherwise associating the heater with a non-disposable utensil body. The susceptor is associated with the remainder of the utensil in a manner such that the heater will be in heat transfer relation to a product to be heated in or on the utensil. The utensil can be in the form of an open top dish, griddle or the like. However, the present compositions will exhaust some of their ability to heat rapidly upon microwave exposure relatively quickly, i.e., after only a few cycles of operation.

Without further elaboration, it is believed that one skilled in the art can, using the preceding description, utilize the present invention to its fullest extent. The following preferred specific embodiments are, therefore, to be construed as merely illustrative and not limitative of the remainder of the disclosure whatsoever. It will be appreciated that other modifications of the present invention, within the skill of those in the food arts, can be undertaken without departing from the spirit and scope of this invention.

EXAMPLE 1

100 grams of exfoliated vermiculite was ground so that 58% passed through a U.S. 70 mesh screen. 30 grams of this sample was then placed in a 150 ml beaker without compaction and microwaved in a 750 watt Amana Radarange® Microwave Oven operating at 2460 MHz. During the microwave exposure of the exfoliated vermiculite the temperature of the vermiculite was recorded using a Luxtron 750® Fluoroptic temperature monitor, equipped with ceramic clad fiber optic temperature probes, and interfaced with an IBM PC/AT computer for real time data collection and analysis. The recorded and averaged temperature profile of the exfoliated vermiculite during the five minute microwave exposure is shown as line 1 in FIG. 8.

EXAMPLE 1A 30 grams of crude vermiculite-Micron grade (46% through U.S. 70 mesh screen) obtained from American Vermiculite Corporation, Atlanta, GA 30329, was placed in a 150 ml beaker and treated as described above. The recorded and averaged temperature profile of the crude vermiculite during the microwave exposure is shown as line 1A in FIG. 8.

EXAMPLE 2

Figure 8:
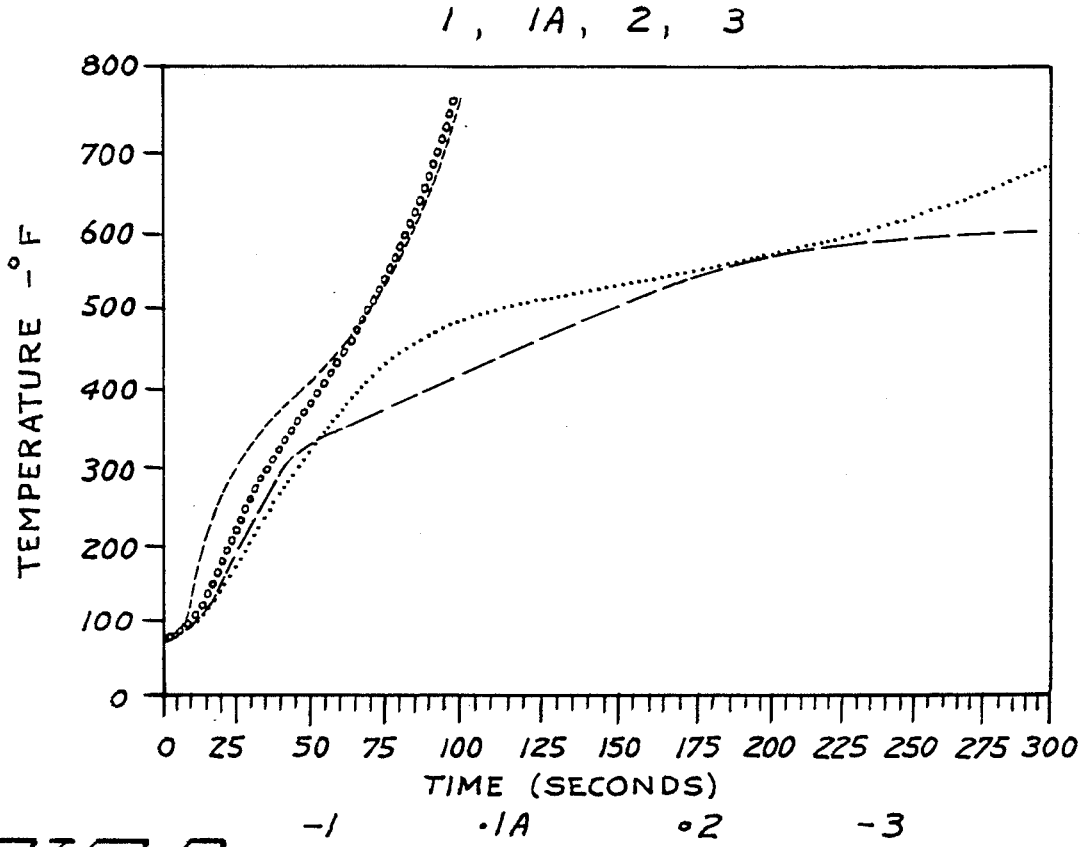
FIGS. 8–14 depict time/temperature response curves for ceramic compositions exemplified in Examples 1–24.

200 grams of ground exfoliated vermiculite was soaked in 0.20 liters of a 0.855M NaCl solution. The sodium chloride concentration being 0.10 g NaCl per gram of vermiculite. The vermiculite was steeped in the brine solution for five hours, filtered and dried at 150° F. (65.6° C.) overnight. 30 grams of this treated ground exfoliated vermiculite was then placed in a 150 ml beaker without compaction and microwaved in a 750 watt Amana Radarange® Microwave Oven operating at 2460 MHz. The recorded and averaged temperature profile of the treated exfoliated vermiculite during the five minute microwave exposure is shown in FIG. 8 as line 2.

EXAMPLE 3

0.128 moles sodium chloride (7.5 grams) was dissolved in 0.48N HCl (125 ml). To this solution was added 35 grams of exfoliated vermiculite. The sodium chloride ratio being 0.214 g NaCl/g vermiculite. After soaking for one hour the vermiculite was filtered, washed until a neutral effluent was obtained and dried for 12 hours at 150° F. (65.6° C.). 15 grams of the dried exfoliated treated vermiculite was placed in a 150 ml beaker and treated as previously described. The recorded and averaged temperature profile during the microwave exposure is shown in FIG. 8 as line 3. While a rapid increase in temperature is observed, it is to be appreciated that this test is made without a food body which would absorb much of the heat if used in an actual package and thus the temperature response is not an example of runaway heating. Also, having the material in a beaker prevents some dissipation of the heat generated. This example is included to illustrate the extreme temperatures achievable, if desired, and useful, for example, to braise meats. Similarly treated materials but when fabricated into susceptors exhibit controlled heating such as shown in Example 24 below.

EXAMPLE 4

Figure 9:
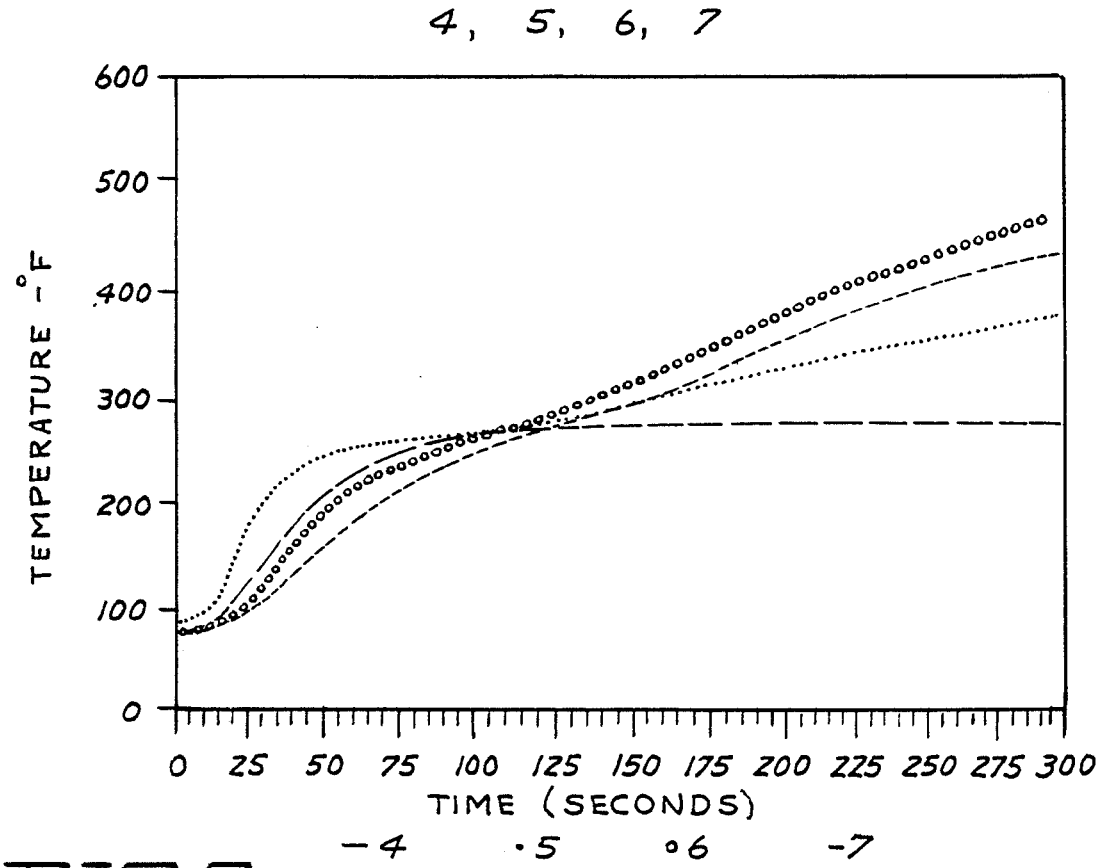

50 grams of ground exfoliated vermiculite was washed with 100 ml of 0.36N HCl for 30 minutes, rinsed until a neutral pH was obtained and dried for three hours at 150° F. (65.6° C.). The dried vermiculite was then mixed with 10 grams of Kentucky Clay #6 (Kentucky-Tennessee Clay Co., Mayfield, KY 42066). The clay-vermiculite mixture was then blended with 50 ml of distilled water and pressed into tiles 3.5 inches square and 0.125 inches thick. The tiles were dried for six hours at 150° F. (65.6° C.). The tiles upon drying exhibited minimal shrinkage (<1%) and were not cracked or warped. Tile weight was 18.0 grams. The tile was then subjected to a 750 watt, 2460 MHz microwave field for a period of five minutes while the temperature of the tile surface was monitored as previously detailed. The recorded and averaged temperature profile of the tile is shown in FIG. 9 as line 4.

EXAMPLE 5

50 grams of the dried treated exfoliated ground vermiculite prepared in Example 2 was mixed with 10 grams of Kentucky Clay #6, hydrated using 50 ml of distilled water and pressed into tiles 0.125 inch thick and 3.5 inches square. After drying for six hours at 150° F. (65.6° C.) the tiles displayed <1% shrinkage and were not warped or cracked. Tile weight was 17.6 grams. The temperature profile of the tile was obtained as described previously in Examples 1 and 4. The temperature profile of the heating structure is shown in FIG. 9 as line 5.

EXAMPLE 6

A formulation comprising 10 grams of ground unslaked exfoliated vermiculite, 6.0 grams sodium metasilicate pentahydrate, 30.0 grams calcium sulfate hemihydrate and 35.0 grams of Tennessee #6 Clay was prepared. The dry mix was hydrated using 50 ml of distilled water and blended until a uniform consistency was obtained. The plastic mass was then formed into tiles 0.125 inch thick and 3.5 inches square and dried at 130° F. (54.4° C.) for 5 hours. Dry tile weight was 22.1 grams and displayed 5% shrinkage without any cracking or warping. The tile was measured for heating performance in a microwave field as previously detailed. The averaged recorded temperature profile of the heating structure is shown in FIG. 9 as line 6.

EXAMPLE 7

50 grams of crude micron grade vermiculite was slaked with 0.1 liters of a 0.36N boric acid solution containing 2.5 grams of sodium chloride. The sodium chloride ratio being 0.05 g NaCl per gram vermiculite or 0.025 grams sodium per gram vermiculite. After a two hour treatment the slaked vermiculite was washed until a neutral effluent was obtained, filtered and dried for several hours at 150° F. (65.6° C.). A formulation was prepared using 10.0 grams of the above prepared boric acid-salt slaked crude vermiculite, 6.0 grams of sodium metasilicate pentahydrate, 30.0 grams of calcium sulfate hemihydrate and 35.0 grams of Tennessee Clay #6. The dry mix blend was hydrated using 50 ml of distilled water until a cohesive plastic mass was developed. The mass was then formed into 3.5 inch squares 0.125 inch thick and dried for 8 hours at 150° F. (65.6° C.). The dried square tiles exhibited 5% shrinkage without any cracking or warping and weighed 28.2 grams. The tiles were then monitored for heating performance in a microwave field as previously detailed. The averaged recorded temperature profile of the heating structure is shown in FIG. 9 as line 7.

EXAMPLE 8

100 grams of crude micron grade vermiculite was slaked with 0.2 liters of a 0.36N triethanolamine solution (a Lewis base). After a 4 hour steeping, the slaked vermiculite was washed with three successive 200 ml charges of distilled water, filtered and oven dried for 3 hours at 120° F. (48.9° C.).

Figure 10:
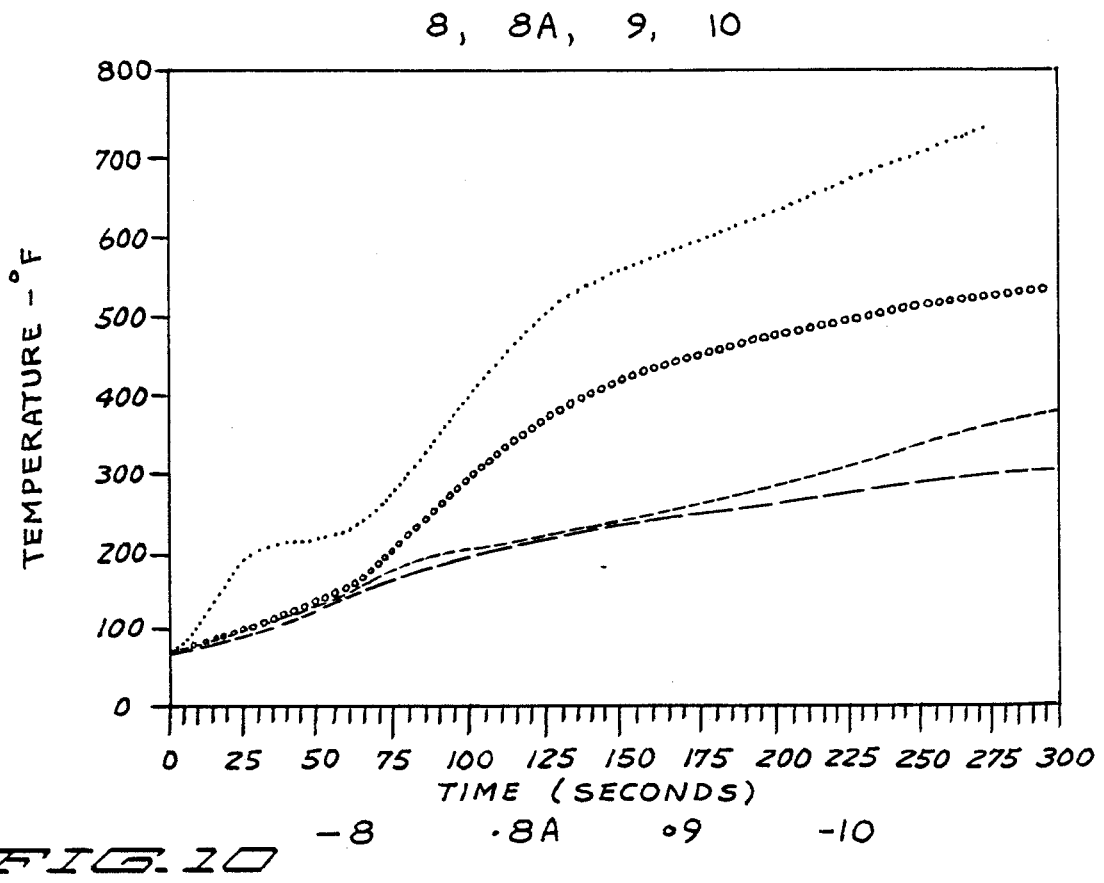

A formulation was prepared using 10.0 grams of the above prepared triethanolamine slaked crude vermiculite, 6.0 grams of sodium metasilicate pentahydrate, 30.0 grams of calcium sulfate hemihydrate and 35.0 grams of Tennessee Clay #6. The drying blend was hydrated using 50 ml of distilled water with mixing until a cohesive plastic mass was developed. The mass was then formed into 3.5 inch squares 0.125 inch thick and dried for 8 hours at 150° F. (65.6° C.). The dried square tiles exhibited 5% shrinkage without cracking or warping and weighed 22.9 grams. The tiles were then measured for heating performance in a microwave field as previously outlined. The averaged recorded temperature profile of the heating structure is shown in FIG. 10 as line 8.

EXAMPLE 8A 30 grams of the triethanolamine treated crude vermiculite prepared above was placed in a 150 ml beaker and treated as previously described in Example 1. The recorded and averaged temperature profile during the five minute microwave exposure is shown in FIG. 10 as line 8A.

EXAMPLE 9

50 grams of crude micron grade vermiculite was treated with a solution containing 8.69 grams $AlC_{13}$ and 0.01 g NaCl per gram vermiculite in 0.1 liters of distilled water. After soaking in the above Lewis Acid solution for 4 hours, the vermiculite was filtered and washed with three successive 200 ml charges of distilled water. The Lewis Acid activated vermiculite was then dried at 150° F. (65.6° C.) for 5 hours. 30 grams of the dried vermiculite was place in a 150 ml beaker and treated as previously described. The recorded and averaged temperature profile during the five minute microwave exposure is shown in FIG. 10 as line 9.

EXAMPLE 10

10 grams of a treated crude micron vermiculite was substituted for the untreated vermiculite as detailed in Example 6. Treatment being as follows: 50 grams of crude micron vermiculite was steeped in 100 ml of a 0.36N NaOH solution (0.0288 g NaOH/g vermiculite or 0.0144 g Na ion/g vermicuite) for several hours, filtered, washed and dried as previsously described. The resulting tiles upon drying weighed 23.4 grams and displayed 5% shrinkage without cracking or warping. The tile was measured for heating performance in a microwave field as previously detailed. The averaged recorded temperature profile of the heating structure is shown in FIG. 10 as line 10.

EXAMPLE 11

Figure 11:
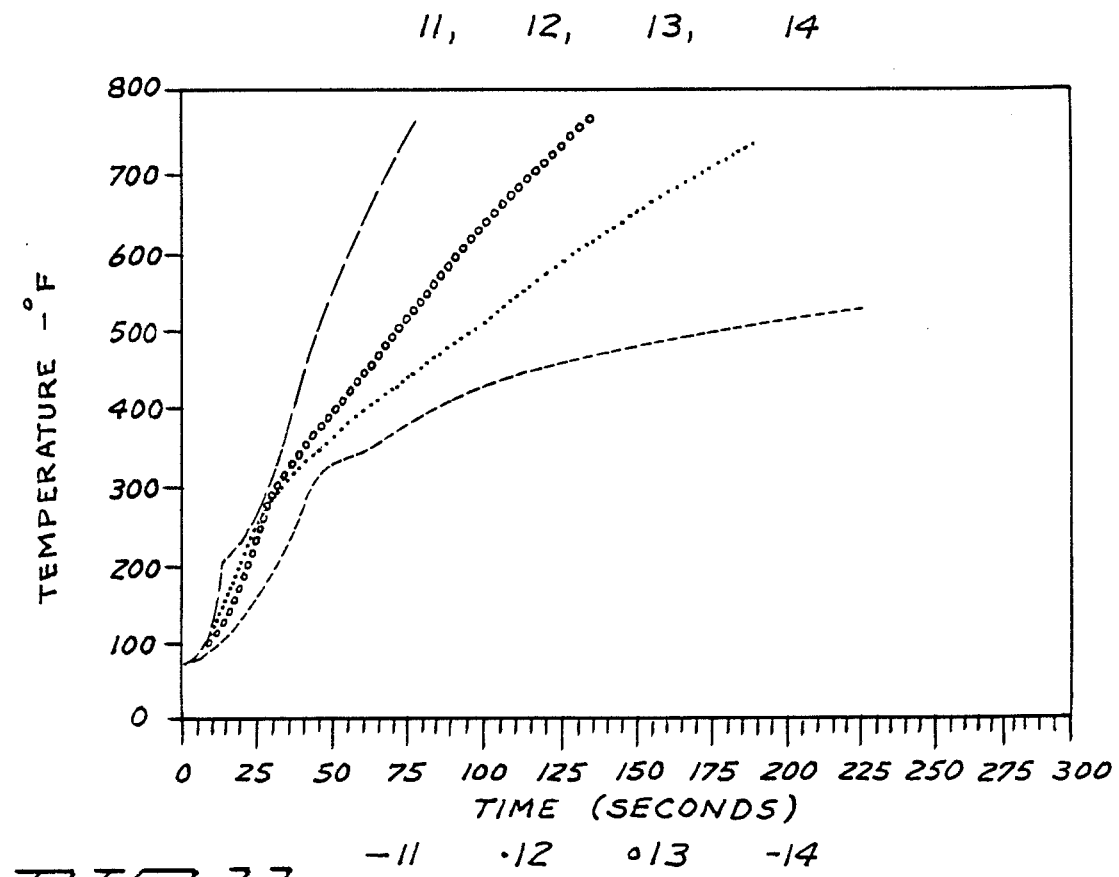

30 grams of the treated crude micron vermiculite as prepared in Example 10 was placed in a 150 ml beaker without compaction and microwaved in a 750 watt microwave oven operating at 2460 MHz. The recorded and averaged temperature profile of the treated vermiculite during the microwave exposure is shown in FIG. 11 as line 11.

EXAMPLE 12

0.128 moles (7.5 grams) of NaCl was dissolved in 200 ml of distilled water. Upon solution, 100 grams of western bentonite-SPV 200, American Colloid Company, Arlington Heights, IL 60004 was mixed into the salt solution slowly with stirring. After dispersing the bentonite, the mixture was allowed to equilibrate for 24 hours. The mixture was then filtered and washed. The treated bentonite-SPV 200 was dried for 12 hours at 150° F. (65.6° C.). 30 grams of the dried treated western bentonite was placed in a 150 ml beaker and treated as previously described. The recorded and averaged temperature profile during the microwave exposure is shown in FIG. 11 as line 12.

A southern bentonite-GK129, Georgia Koalin, Elizabeth, NJ 07207 and a U.S. southern bentonite-Barabond, NL Baroid/NL Industries, Inc., Houston, TX 77001 were treated as detailed above and produced very similar results in most respects. Note: western bentonites tend to be sodium bentonites while southern bentonites (Mexican or U.S.) tend to be considered calcium bentonites.

EXAMPLE 13

100 grams of western bentonite-SPV 200 was dispersed with stirring into 200 ml of a 0.36N sodium bicarbonate solution and allowed to equilibrate for 4 hours. The mixture was filtered and washed. The treated bentonite was then dried for 12 hours at 150° F. (65.6° C.). 30 grams of the dried treated bentonite was placed into a 150 ml beaker and evaluated for microwave coupling as previously described. The recorded and averaged temperature profile during the five minute microwave exposure is shown in FIG. 11 as line 13. Similar results were obtained when the above procedure was replicated using a southern bentonite.

EXAMPLE 14

A formulation comprising 6.0 grams sodium meta silicate pentahydrate, 30 grams calcium sulfate hemihydrate, 35 grams of Tennessee Clay #6, 10 grams of exfoliated ground vermiculite (treated as detailed in Example 3) and 50 grams of southern bentonite GK129 (Georgia Kaolin) was prepared. The dry mix was hydrated using 70 ml of distilled water and blended into a uniform mass. The mix was then formed into 3.5 inch square by 0.125 , inch thick tiles and dried at 150° F. (65.6° C.) for 5 hours. Dry tile weight was 26.2 grams and displayed no shrinkage, cracking or warpage. The tile was measured for heating performance in a microwave field as previously detailed. The recorded and averaged temperature profile of the heating structure is shown in FIG. 11 as line 14.

EXAMPLE 15

Figure 12:
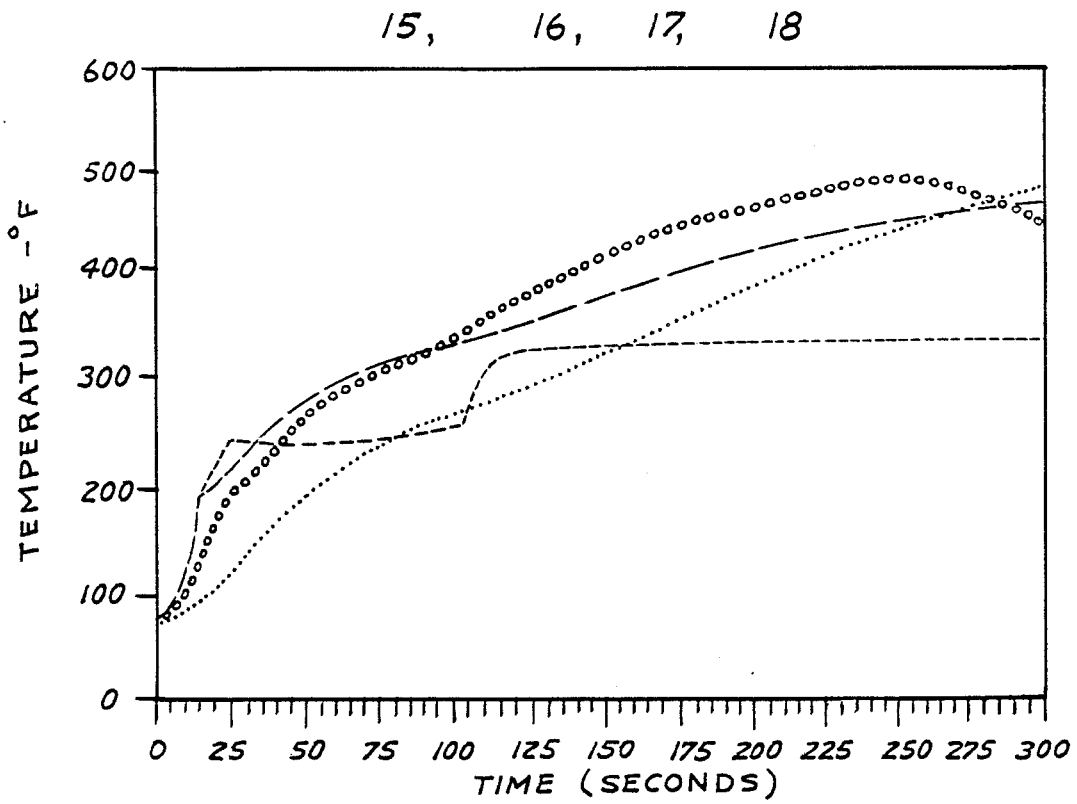

A repeat of Example 14 with a substitution of a western bentonite SPV-200 (American Colloid Inc.) for the southern bentonite GK129 stated. The dry tile weight was 26.4 grams and exhibited no cracking, warping or shrinkage. The tile was measured for heating performance in a microwave field as previously described. The recorded and averaged temperature profile of the heating structure is shown in FIG. 12 as line 15.

EXAMPLE 16

A formulation with the following make-up was prepared: 5.0 grams sodium metasilicate, 30 grams calcium sulfate hemihydrate, 50 grams of southern bentonite GK129 (Georgia Kaolin), 15.0 grams of silica flour-400 mesh (Ottawa Silica Co., Ottawa, IL 61350), 12.5 grams of treated crude micron vermiculite (prepared in Example 10) and 12.5 grams glauconite (green sand-available from Zook and Ranck, Gap, PA 17527). The dry mix was hydrated with 70 ml of distilled water, mixed into a plastic mass, formed into squares 3.5 inches ×3.5 inches ×0.125 inch thick and dried at 150° F. (65.6° C.) for 4 hours. Dry tile weight was 27.1 grams and exhibited no cracking, shrinkage or deformation. The tile was measured for heating performance in a microwave field as previously described. The recorded and averaged temperature profile of the heating structure is shown in FIG. 12 as line 16.

EXAMPLE 17

A repeat of Example 14 with the following modification; a treated crude micron vermiculite (prepared in Example 10) was substituted for the exfoliated ground treated vermiculite in its entirety and a western bentonite SPV-200 (sodium bentonite available from American Colloid Inc.) was substituted for the southern bentonite GK129 (Georgia Kaolin) in its entirety. The dry tile weight was 26.8 grams and exhibited no shrinkage, cracking or deformations. The tile was measured for heating performance in a microwave field as previously detailed. The recorded and averaged temperature profile of the heating structure is shown in FIG. 12 as line 17.

EXAMPLE 18

The following formulation was prepared and dry blended to a uniform consistency; 5.0 grams sodium metasilicate pentahydrate, 30 grams calcium sulfate hemihydrate, 15 grams bauxite X-5111-medium fine grind (Englehard Corporation, Edison, NJ 08818), 50 grams Georgia Kaolin GK-129 bentonite, 15 grams silica flour and 15 grams of treated crude vermiculite prepared in Example 10. The dry mix was hydrated with 55 ml of distilled water, mixed, formed into a sheet 7.5 inches×5.5 inches×0.030–0.035 inch thick containing a non-woven fiberglass matt (Elk Corporation, Ennis, TX 75119) for internal support and dried for 3 hours at 150° F. (65.6° C.). The dry tile/matting weighed 27.4 grams and was flexible. The tile was measured for heating performance in a microwave field as previously described. The recorded and averaged temperature profile of the heating structure is shown in FIG. 12 as line 18.

EXAMPLE 19

Figure 13:
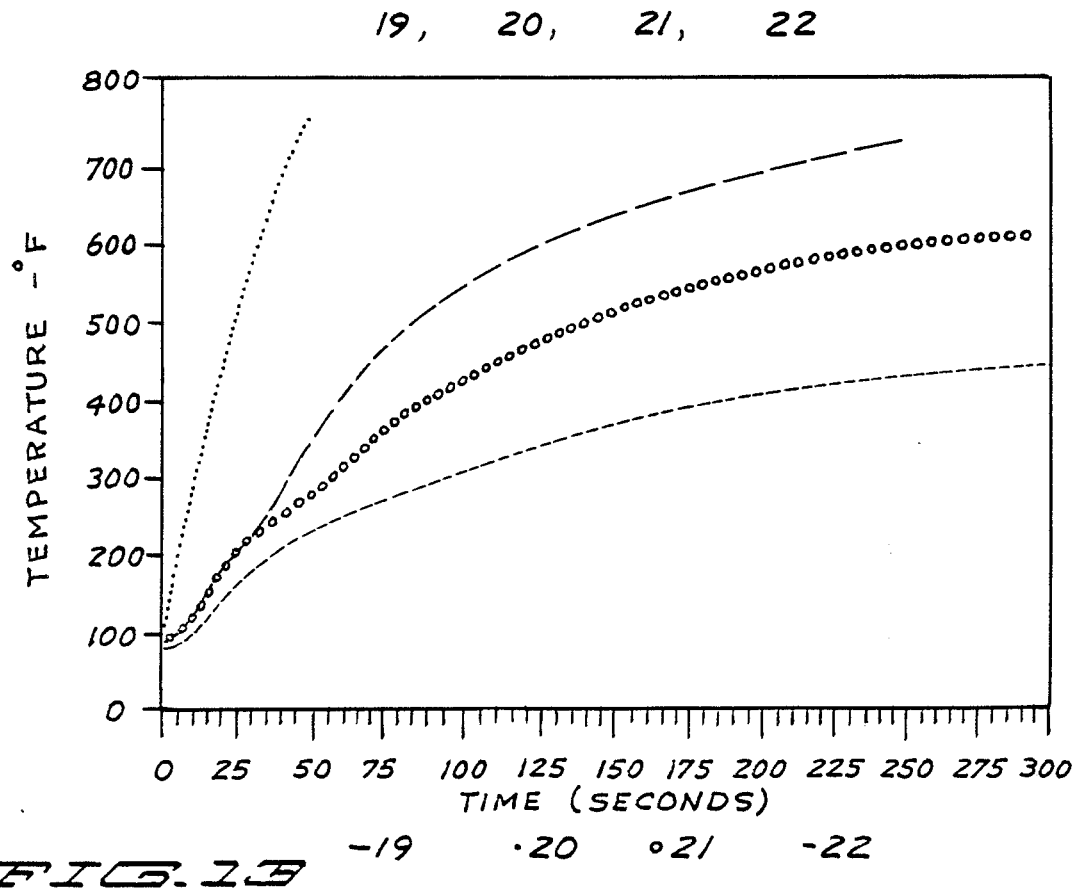

The following formulation was prepared and dry blended to a uniform consistency; 6.0 grams sodium metasilicate pentahydrate, 15.0 grams calcium sulfate hemihydrate, 50 grams of western bentonite (NL Baroid, Houston, TX, Standard 200 mesh), 20 grams hectorite-Hectalite 200 (American Colloid Company, Skokie, IL), 30 grams M&D clay (Kentucky-Tennessee Clay Company, Inc., Mayfield, KY), 37 grams of treated crude vermiculite prepared in Example 10 and 15 grams of 200 S phologophite Mica (Suzorite Mica Products, Hunt Valley, MD). The dry mix was hydrated with 81 ml of distilled water containing 7.5 grams of sodium chloride, mixed to a plastic consistency, formed as described in Example 18 to a thickness of 0.050–0.055 inch and dried for several hours at 150° F. (65.6° C). The dry tile/matting weighed 60 grams and was rigid. The tile was measured for heating performance in a microwave field as previously described. The recorded and averaged profile of the heating structure is shown in FIG. 13 as line 19.

EXAMPLE 20

Prepared as detailed in Example 19 with the following modifications: 30 grams of Tennessee Clay #6 was substituted for the M&D Clay, 37 grams of 200 S mica (Suzorite Mica Products, Hunt Valley, MD) was added for a total of 52 grams of 200 S mica. The 6×6 inch×0.060 inch thick tile weighed 38.6 grams. The structure was measured for heating performance in a microwave field as previously described. The recorded and averaged temperature profile is shown in FIG. 13 as line 20.

EXAMPLE 21

Prepared as outlined in Example 19 with 30 grams of Tennessee Clay #6 substituted for the 30 grams of M&D Clay. The prepared tile measured 6 inches square and 0.050–0.055 inch thick and weighed 52 grams. The tile was measured for heating performance in a microwave field as previously described. The recorded and averaged temperature profile of the structure is shown in FIG. 13 as line 21.

EXAMPLE 22

Prepared as outlined in Example 19 using 22 grams of treated crude vermiculite as prepared in Example 10. The prepared tile measured 6.0×6.0 inches×0.060–0.065 inch and weighed 58 grams. The tile was measured for heating performance in a microwave field as previously described. The recorded and averaged temperature profile of the structure is shown in FIG. 13 as line 22.

EXAMPLE 23

Figure 14:
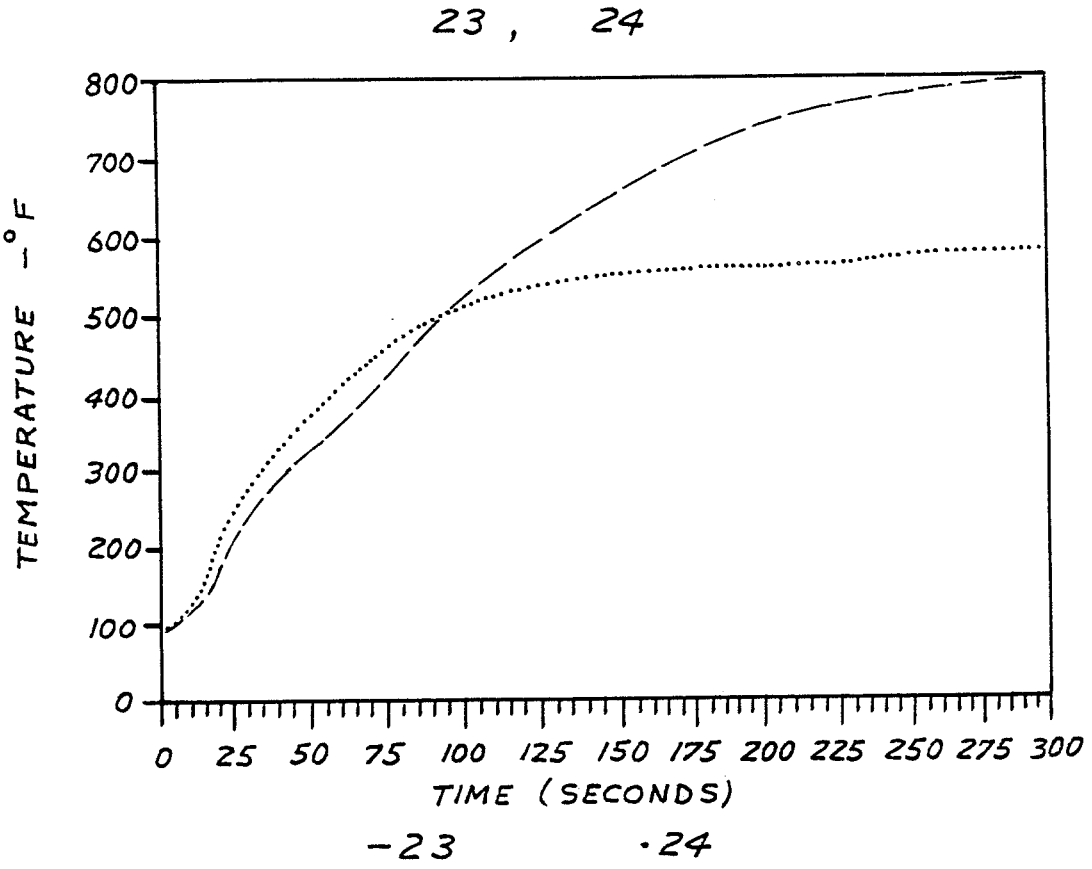

The following formulation was prepared and dry blended to a uniform consistency; 6.0 grams sodium metasilicate pentahydrate, 20 grams calcium sulfate hemihydrate, 50 grams western bentonite Standard 200 mesh Baroid, 20 grams hectorite-Hectalite 200, 30 grams M&D Clay, and 37 grams of treated crude vermiculite as prepared in Example 10. The dry mix was hydrated with 81 ml of tap water, mixed to a plastic mass and formed as described in Example 18. The prepared structure was 6.0×6.0×0.050 inch and weighed 35 grams. The structure was measured for heating performance in a microwave field as previously described. The recorded and averaged temperature profile is shown in FIG. 14 as line 23.

EXAMPLE 24

A mixture of 40 grams of bentonite prepared in Example 13 and 40 grams of treated crude vermiculite prepared in Example 10 was made. The dry mix was coated on a 1 mil Kapton® film (E. I. DuPont De Nemours & Company, Inc., Wilmington, DE) using a high temperature adhesive. The 3.5×3.5 inch heater weighed 12 grams and was very flexible. The structure thickness was 0.050 inch. The flexible heating structure was measured for heating performance in a microwave field as previously described. The recorded and averaged temperature profile is shown in FIG. 14 as line 24.

What is claimed is:

1. A package article for food to be heated by microwave energy in a microwave oven comprising:

a tray for holding a food item having a top and bottom surface, a substantially planar microwave heating susceptor disposed within said tray, said microwave heating susceptor fabricated from a ceramic composition, comprising:

a ceramic binder; and a ceramic susceptor material which absorbs energy and having a residual lattice charge, wherein the compound is unvitrified, and wherein the susceptor is in intimate physical contact with the food item and ranges in thickness from about 0.5 to 8 mm.

2. The article of claim 1 wherein the binder comprises about 2% to 99.9% by weight of the composition and wherein the ceramic susceptor material comprises about 0.1% to 98% of the composition.

3. The composition of claim 2 wherein the ceramic composition additionally comprises 0.1% to 6% of sodium chloride.

4. The article of claim 3 wherein the ceramic susceptor material is selected from the group consisting of vermiculite, glauconite, Bentonite, zeolites, phologophite mica, biotite mica, Hectorite, Chlorite, Illite, Attapulgite, Saponite, Sepiolite, ferriginous smectite, kaolinites, Halloysites, and mixtures thereof.

5. The article of claim 4 wherein the binder is selected from the group consisting of calcium sulphate, cements, calcite, silica fiber, whether amorphorus or crystalline, dolomite, aragonite, feldspar, pulverized polyamide fibers, colloidal silicas, fumed silicas, fiberglass, wood pulp, cotton fibers, thermoplastic resins and thermosetting resins.

6. The article of claim 5 additionally comprising:

a sleeve fabricated from a dielectric material having a top major surface, a bottom major surface spaced apart and parallel to the top surface, a pair of spaced, parallel walls and a pair of spaced, opposite side openings and wherein disposed within which sleeve is the tray.

7. The article of claim 6 wherein the tray comprises a tray bottom wall and a side wall, and wherein the susceptor conforms to the shape of the tray bottom wall and is disposed above the tray bottom wall.

8. The article of claim 7 additionally comprising a food item disposed within the tray on top of the susceptor.

9. the article of claim 8 wherein the article additionally comprises a second heating susceptor disposed within the tray spaced apart and parallel to the first susceptor, said second susceptor overlaying the food item and in-.Physical contact therewith.

10. The article of claim 7 or 8 wherein the tray is circular.

11. The article of claim 7 or 8 wherein the tray includes a plurality of side walls at least two of which are parallel and of equal size and wherein the first and second susceptor are compositionally similar.

12. A package article for food to be heated in a microwave oven, a microwave heating susceptor in the form of a tray for holding a food item; wherein the susceptor is capable of heating in a microwave oven, and wherein said susceptor is fabricated from a ceramic composition, comprising:

a ceramic binder; and a ceramic susceptor material which absorbs energy and having a residual lattice charge, wherein the compound is unvitrified.

13. The article of claim 12 wherein the binder comprises about 2% to 99.9% by weight of the composition and wherein the ceramic susceptor material comprises about 0.1% to 98% of the composition.

14. The composition of claim 13 wherein the ceramic composition additionally comprises 0.1% to 10% of sodium chloride.

15. The article of claim 14 wherein the ceramic susceptor material is selected from the group consisting of vermiculite, glauconite, bentonite, zeolites, phologophite mica, biotite mica, hectorite, chlorite, Illite, Attapulgite, saponite, sepiolite, ferriginous smectite, kaolinites, halloysites and mixtures thereof.

16. The article of claim 15 wherein the binder is selected from the group consisting of calcium sulphate, cements, dolomite, calcite, silica fiber whether amorphorus or crystalline, aragonite, feldspar, pulverized polyamide fibers Kelvar, colloidal silicas, fumed silicas, fiberglass, wood pulp, cotton fibers, thermoplastic resins and thermosetting resins.

17. The article of claim 16 wherein the ceramic susceptor material is in amphoteric form.

18. The article of claim 17 additionally comprising:

a sleeve fabricated from a dielectric material having a top major surface, a bottom major surface spaced apart and parallel to the top surface, a pair of spaced, parallel walls and a pair of spaced, opposite side openings and wherein disposed within which sleeve is the tray.

19. The article of claim 18 wherein the tray comprises a tray bottom wall and a side wall, and wherein the susceptor conforms to the shape of the tray bottom wall and is disposed above the tray bottom wall.

20. The article of claim 9 or 19 additionally comprising a food item disposed within the tray.

* * * * *